US005842098A

United States Patent [19]

Ueno et al.

[11] Patent Number: 5,842,098

[45] Date of Patent: Nov. 24, 1998

[54] FIXING APPARATUS AND FIXING METHOD FOR ELECTROPHOTOGRAPHIC APPARATUS

[75] Inventors: Hiroshi Ueno; Shuho Yokokawa; Kunitomo Takahashi; Sho Sawahata; Ken Onodera; Tetsuya Ohba, all of Ibaraki, Japan

[73] Assignee: Hitachi Koki Co., Ltd., Tokyo, Japan

[21] Appl. No.: 954,825

[22] Filed: Oct. 21, 1997

[30] Foreign Application Priority Data

Oct. 25, 1996 [JP] Japan ..... 8-283732

[51] Int. Cl.[6] ..... G03G 13/20

[52] U.S. Cl. ..... 399/322; 399/332; 399/384; 399/400

[58] Field of Search ..... 399/322, 330, 399/331, 332, 384, 400, 407

[56] References Cited

U.S. PATENT DOCUMENTS 5,166,735 11/1992 Malachowski ..... 399/322 X
5,428,433 6/1995 Kopp et al. ..... 355/285

FOREIGN PATENT DOCUMENTS 62-224821 10/1987 Japan .
63-292177 11/1988 Japan .
4-321062 11/1992 Japan .
7-44043 2/1995 Japan .

*Primary Examiner*—Nestor R. Ramirez
*Attorney, Agent, or Firm*—Sughrue, Mion, Zinn, Macpeak & Seas, PLLC

[57] ABSTRACT

In a fixing apparatus for an electrophotographic apparatus which comprises a suction apparatus (14) for attracting a rear surface of recording material (6) which continues longitudinally and holds a toner image on a major surface thereof, a preheater (10) for preheating the recording material while adhering the recording material to the preheater by attracting force of the suction apparatus, and a pair of fixing rollers (11) formed by a heat roller and a pressure roller urged to each other, wherein the recording material is sandwiched and carried while being heated and pressurized by the heat roller and the pressure roller at a pressing portion therebetween thereby to fix the toner image on the major surface of the recording material, the fixing apparatus further comprises a recording material lifting apparatus (15) having a projection member (15*a*) movable relative to the surface of the preheater.

7 Claims, 3 Drawing Sheets

FIXING APPARATUS AND FIXING METHOD FOR ELECTROPHOTOGRAPHIC APPARATUS

BACKGROUND OF THE INVENTION

1. Field of the Invention

The present invention relates to a fixing apparatus and a fixing method for an electrophotographic apparatus which fixes a toner image formed on the surface of recording material to the surface of the recording material thereby to obtain a printed material. In particular, the present invention relates to a fixing apparatus and a fixing method suitable for an electrophotographic printing system which prints on both sides of recording material by using a plurality of the electrophotographic apparatuses.

2. Description of the Related Art

Conventionally, as an electrophotographic apparatus, there is known one which is arranged to print an image as a toner image on the surface of recording material such as a continuous paper continuing to its longitudinal direction. Further, as a fixing apparatus which is mounted in such a kind of electrophotographic apparatus and fixes a toner image on the surface of the recording material, there is known one arranged in the following manner. That is, in such a fixing apparatus, a suction apparatus, a preheater, and a pair of fixing rollers formed by a heat roller and a pressure roller capable of being urged to each other are sequentially arranged along the transfer direction of the recording material. The recording material holding a toner image on the major surface thereof is transferred while the rear surface thereof is attracted by the suction apparatus, whereby the recording material is adhered to the surface of the preheater and preheated. Then, the recording material is sandwiched and carried while being heated and pressurized by the heat roller and the pressure roller at a pressing portion therebetween thereby to fix the toner image on the major surface of the recording material. Such a fixing apparatus is disclosed in Japanese Patent Unexamined Publication No. Sho 63-292177, for example.

In such a kind of fixing apparatus, in general, the higher the setting temperature of the preheater and heat rollers is and the larger the pressing force of the pressure roller against the heat roller is, the larger the fixing intensity of a toner image with respect to the recording material becomes.

There is known an electrophotographic printing system of both sides printing type, as described in Japanese Patent Unexamined Publication Nos. Sho 62-224821 and Sho 4-321062, which is provided with a print sheet reversing apparatus for reversing recording material disposed between two electrophotographic apparatuses of one side printing type arranged side by side, wherein the electrophotographic apparatus of the former stage prints an image on the major surface of the recording material, then the print sheet reversing apparatus reverses the recording material whose major surface is thus printed with the image and supplies the recording material thus reversed to the electrophotographic apparatus of the rear stage thereby to print an image also on the rear surface of the recording material. In such an electrophotographic printing system, however, it is impossible to realize the both sides printing with good quality when two electrophotographic apparatuses whose fixing environments such as fixing temperature is merely set to be same are disposed side by side. In particular, it is impossible to realize the both sides printing with good quality without sufficiently taking the fixing environments of the electrophotographic apparatus of the rear stage into consideration.

A preheater is arranged to contact with a surface of recording material opposite to a surface thereof where a toner image was transferred thereby to preheat the recording material. Accordingly, in an electrophotographic printing system which is arranged to print images on both sides of recording material by using two electrophotographic apparatuses, a fixed toner image fixed by the printing operation of the electrophotographic apparatus of the former stage exists on a surface of the recording material opposite to a surface thereof where an image is to be printed by the electrophotographic apparatus of the rear stage. Therefore, the preheater of the electrophotographic apparatus of the rear stage contacts to the surface of the recording material on which the fixed toner image has been formed thereby to preheat the recording material. In this case, if the recording material is excessively preheated by the preheater of the electrophotographic apparatus of the rear stage, the fixed toner image is again softened and then adhered to the preheater and a blank portion of the recording material, thereby causing the contamination of the device and the degradation of the printed quality.

The preheating value of the preheater of a generally used electrophotographic apparatus of one side printing type is set on the condition that there is no fixed toner image on the surface of the recording material to which the preheater contact. In order to realize good fixing characteristics at a high-speed printing operation, it is preferable that the preheater preheats the recording material to a temperature sufficient for softening a toner image. In this respect, the preheater is heated to a quite high temperature of about 100° C. When electrophotographic apparatus of both sides printing type is arranged by using two electrophotographic apparatuses of one side printing type each having such a preheater for preheating the recording material at a high temperature, there appears such a phenomenon as described above that the toner image having been fixed is softened again thereby to cause the contamination of the device and the degradation of the printed quality.

Accordingly in the prior art, in the case of arranging an electrophotographic apparatus of both sides printing type by using two electrophotographic apparatuses of one side printing type, it has been intended to eliminate the aforesaid problem by employing the following arrangement. That is, the setting temperature of the preheater of the electrophotographic apparatus of the rear stage is set to a low value of about 70° C., or the electrophotographic apparatus of the rear stage is arranged not to have a preheater and a heat value lacked due to the elimination of the preheater is compensated by winding the recording material around the heat roller by a predetermined length (refer to U.S. Pat. No. 5,428,433), or a layer formed by material such as PTFE or PFA compound to which toner is hardly adhered is provided on the surface of the preheater (see Japanese Patent Unexamined Publication No. Hei 7-44043).

SUMMARY OF THE INVENTION

The present invention has been made to solve the above problem, and therefore an object of the present invention is to provide a fixing apparatus and a fixing method which, in the case of arranging an electrophotographic printing system of both sides printing type by using a plurality of electrophotographic apparatuses of one side printing type, is not required to provide an arrangement for winding the recording material around the heat roller nor to provide a resin layer on the surface of the preheater, further which is able to set the setting temperature of the preheater at 70° C. or more, and which is able to make the variance of efficiency of the fixing apparatuses between the electrophotographic apparatus of the former stage and the electrophotographic apparatus of the rear stage quite small.

Another object of the present invention is to provide a fixing apparatus and a fixing method for an electrophotographic apparatus which is able to, at the time of restarting the printing operation, restore print material, which was once lifted from the preheater at the time of stopping the printing operation (that is, at the time of non-fixing operation), accurately to the original position at the time of stopping the printing operation.

In order to achieve the above object, there is provided with a fixing apparatus for an electrophotographic apparatus which comprises a suction apparatus for attracting a rear surface of recording material which continues longitudinally and holds a toner image on a major surface thereof, a preheater for preheating the recording material while adhering the recording material to the preheater by attracting force of the suction apparatus, and a pair of fixing rollers formed by a heat roller and a pressure roller urged to each other, wherein the recording material is sandwiched and carried while being heated and pressurized by the heat roller and the pressure roller at a pressing portion therebetween thereby to fix the toner image on the major surface of the recording material, and wherein the fixing apparatus further comprises a recording material lifting apparatus having a projection member movable relative to the surface of the preheater.

The above and other objects and features of the present invention will be more apparent from the following description taken in conjunction with the accompanying drawing.

DETAILED DESCRIPTION OF THE PREFERRED EMBODIMENTS

Embodiments of the present invention will be described with reference to the accompanying drawings.

Figure 2:
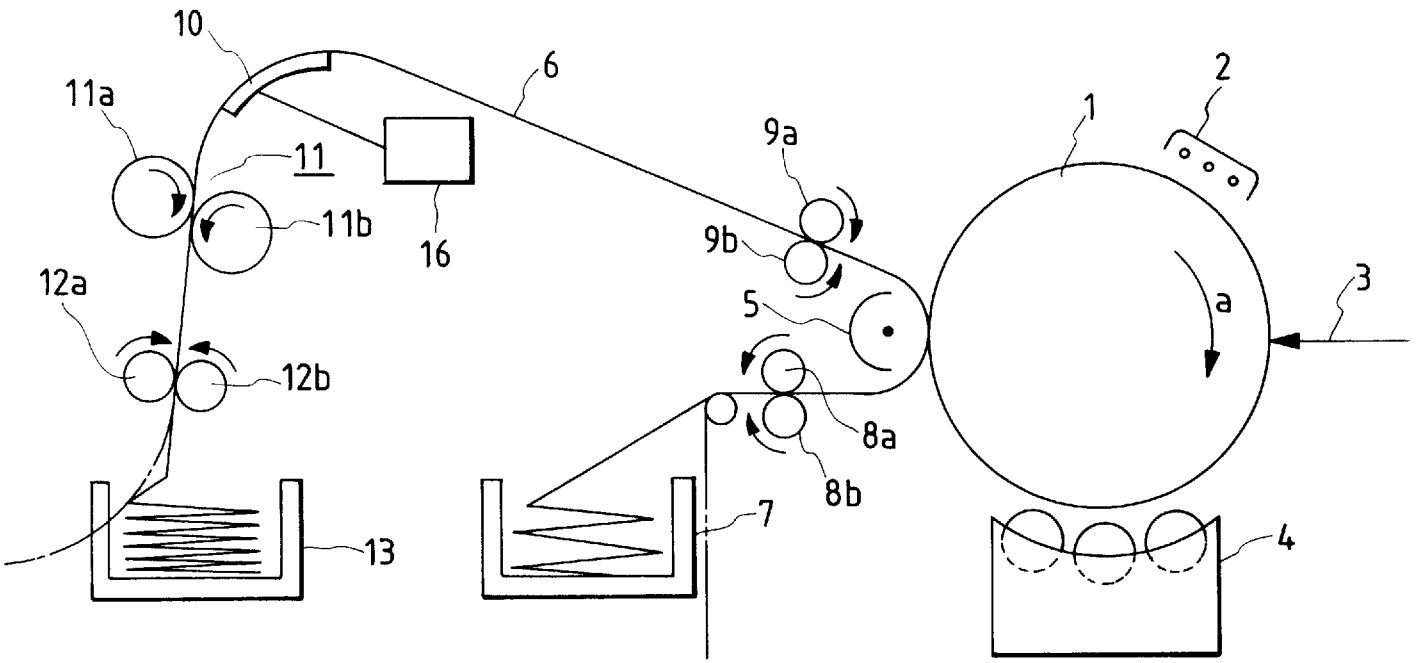
FIG. 2 is a schematic diagram showing an arrangement of an electrophotographic apparatus.

Firstly, an electrophotographic apparatus of one side printing type will be explained with reference to FIG. 2. In the figure, a reference numeral 1 depicts a photosensitive drum which forms a toner image thereon through the electrophotographic process and is supported by a supporting axis so that the photosensitive drum 1 rotates to a direction indicated by an arrow "a" at a constant speed. A charger 2 is disposed to oppose to the surface of the photosensitive drum 1 thereby to uniformly charge the surface of the photosensitive drum 1 which passes the charger 2 in opposite relation. A laser beam 3, for exposing the surface of the photosensitive drum 1 which is charged uniformly, is modulated by a print information signal supplied from an information processing apparatus thereby to form an electrostatic latent image on the surface of the photosensitive drum 1. A development apparatus 4 is disposed to oppose to the surface of the photosensitive drum 1 on which the electrostatic latent image is formed. The development apparatus 4 has a developing function that powder toner are made adhered to the surface of the photosensitive drum 1 by the electrostatic power of the electrostatic latent image thereby to form a toner image.

A sheet hopper 7 receives, in a folded state, a continuous recording material (printing sheet) 6 of belt-like configuration to which the toner image is transferred and fixed thereby to perform image printing thereon. Transfer rollers 8*a,* 8*b* forming a part of a print sheet transfer means take in the print sheet 6 from the hopper 7 and send to the photosensitive drum 1.

The print sheet 6 sent out from the transfer rollers 8*a,* 8*b* is made in contact with the surface of the photosensitive drum 1 so that the toner image is transferred to the surface of the print sheet from the photosensitive drum 1. A transfer unit 5 applies electric charge, whose polarity is in opposite to that of the toner image, to the rear surface of the print sheet 6 being in contact with the photosensitive drum 1, thereby to generate on the rear surface of the print sheet 6 electrostatic force for moving (transferring) the toner image formed on the surface of the photosensitive drum 1 to the surface of the print sheet 6.

Transfer rollers 9*a,* 9*b* forming the other part of the print sheet transfer means send the print sheet 6, on which the toner image has been transferred, to a preheater 10. The preheater 10 is disposed at the upstream side of fixing rollers 11 and made in contact with the rear surface of the print sheet 6 holding the toner image thereon, thereby to preheat the print sheet 6.

The preheater 10 is arranged for example in a manner that an electric heater is mounted to the rear surface of a heat transfer member with which the rear surface of the print sheet 6 contacts. The preheater 10 heats the print sheet 6 to such a degree that the toner image adhered to the print sheet 6 is softened while the print sheet 6 moves in a state of being in contact with the surface of the preheater 10. The temperature of the preheater 10 can be adjusted by controlling the current supplied to the electric heater by a temperature control device 16.

The pair of fixing rollers 11 formed by a heat roller 11*a* and a pressure roller 11*b* urged to each other heat and pressurize the print sheet 6 which was made in contact with the preheater 10 and preheated, thereby fixing the toner image on the surface of the print sheet 6.

Figure 1:
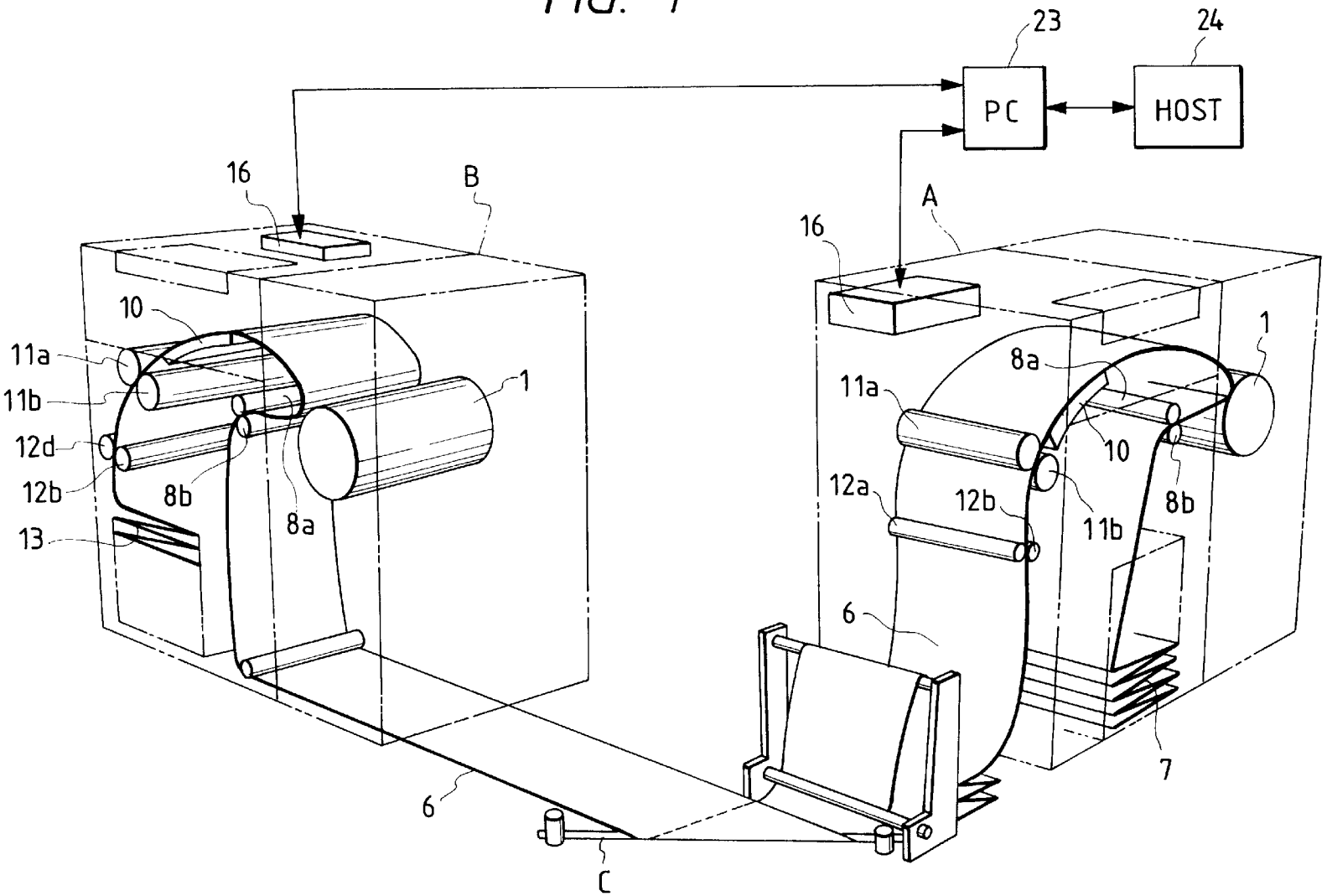
FIG. 1 is a schematic diagram showing an arrangement of an electrophotographic printing system.

The print sheet 6 sent from the fixing rollers 11 is pulled in by puller rollers 12*a,* 12*b* and then folded and received within a stacker 13 or ejected out of the electrophotographic apparatus. FIG. 1 shows an arrangement of an electrophotographic printing system of both sides printing type formed by using two electrophotographic apparatuses A and B of one side printing type each arranged in the aforesaid manner. The electrophotographic apparatus A of the former stage and the electrophotographic apparatus B of the rear stage are arranged side by side so as to be connected in a subordinate relation. A print sheet reversing apparatus C is disposed between the electrophotographic apparatus A of the former stage and the electrophotographic apparatus B of the rear stage. The print sheet reversing apparatus reverses the print sheet 6, which has been printed on its major surface and ejected from the electrophotographic apparatus A of the former stage, and transfers it to the electrophotographic apparatus B of the rear stage. Then, the electrophotographic apparatus B of the rear stage prints an image on the rear surface of the print sheet 6.

In such an electrophotographic printing system, the electrophotographic apparatus A of the former stage takes in the print sheet 6 from the hopper 7 and prints an image thereon, and ejects the print sheet 6 thus printed to the outside of the apparatus. Then, the electrophotographic apparatus B of the rear stage prints an image on the print sheet 6 taken in from the print sheet reversing apparatus C thereby to have the print sheet thus printed received within the stacker 13.

A print controller 23 forming a part of a higher-rank control apparatus in a control system of the electrophotographic printing system controls the two electrophotographic apparatuses A and B in accordance with print information supplied from a host computer 24 which is a higher-rank unit of the print controller.

Figure 3:
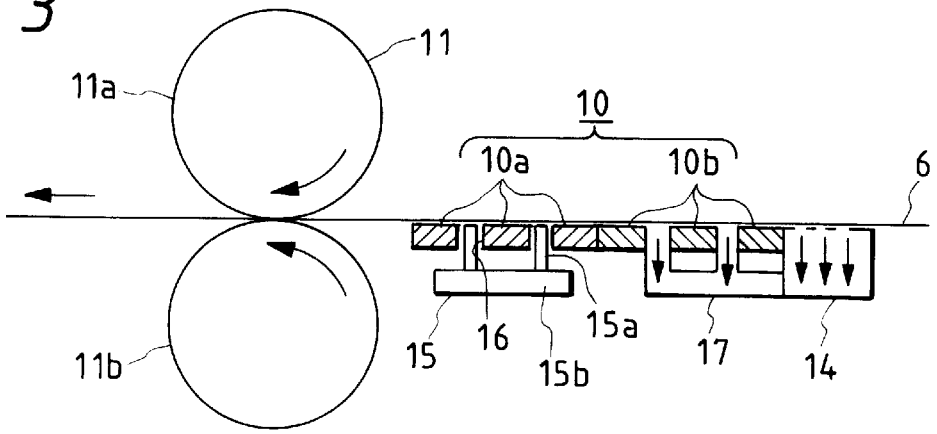
FIG. 3 is a side view showing a main part of an electrophotographic apparatus according to the present invention.
Figure 4:
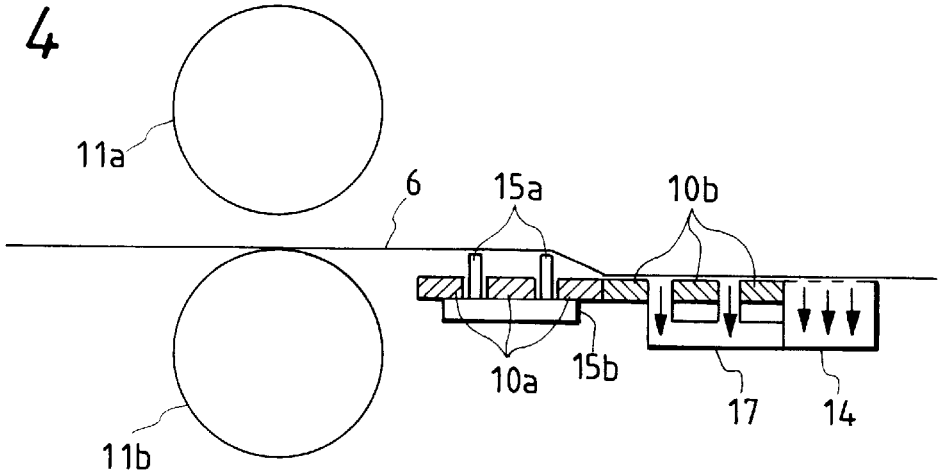
FIG. 4 is a side view showing a main part of an electrophotographic apparatus according to the present invention.

In the present invention, in order to form the electrophotographic printing system of both sides printing type by using the aforesaid two electrophotographic apparatuses A and B of one side printing type, the fixing apparatus of at least the electrophotographic apparatus B of the rear stage is arranged in a manner shown in FIGS. 3 and 4.

FIG. 3 is a side view showing the state of the fixing apparatus at the time of printing operation, and FIG. 4 is a side view showing the state of the fixing apparatus at the time of stopping the printing operation.

The fixing apparatus is formed by a suction apparatus 14 for attracting the rear surface of the print sheet 6 holding a toner image (not shown) thereon, the preheater 10 for preheating the print sheet 6 while adhering the print sheet 6 thereto by the suction power of the suction apparatus 14, the pair of fixing rollers 11 formed by the heat roller 11*a* and the pressure roller 11*b* urged to each other, and a recording material lifting apparatus 15.

The recording material lifting apparatus 15 is formed by a base member 15*b* supported, for example, by a fixed member (not shown) of the fixing apparatus and a projection member 15*a* of pin-like configuration fixed on the upper surface of the base member 15*b*. An opening portion 16 such as a through hole or a slit having a size capable of being engaged with the projection member 15*a* is provided at a portion of the preheater 10 opposing to the tip portion of the projection member 15*a*. The opening portion is arranged in a manner that the projection member 15*a* protrudes from the surface of the preheater 10 through the opening portion 16 when the preheater 10 moves down to the position shown in FIG. 4.

The preheater 10 is formed by a high-temperature preheater 10*a* disposed at a position closer to the heat roller 11*a* along the transferring direction of the print sheet 6 and a low-temperature preheater 10*b* disposed at the upstream side with respect to the high-temperature preheater 10*a* along the transferring direction of the print sheet. The projection member 15*a* of the recording material lifting apparatus 15 is provided so as to be movable relative to the surface of the high-temperature preheater 10*a*. In addition to the suction apparatus 14, a suction apparatus 17 is provided at the lower portion of the low-temperature preheater 10*b* so as to adhere the print sheet 6 thereto.

In the above arrangement, a toner image transferred on the surface of the print sheet 6 is preheated by the low-temperature preheater 10*b* and the high-temperature preheater 10*a*, then heated and pressurized by the heat roller 11*a* and the pressure roller 11*b* thereby to be fixed to the print sheet. The suction apparatus 14 provided just before the preheater 10 and the suction apparatus 17 provided at the lower portion of the low-temperature preheater 10*b* serve to improve the adhesion property between the print sheet 6 and the preheater 10.

Such a technical concept can also be applied to the fixing apparatus of the electrophotographic apparatus A of the former stage. In this case, in the fixing apparatus of the electrophotographic apparatus A of the former stage, since there is no toner image on the surface side of the print sheet 6 to which the preheater 10 contacts, it is preferable to provide the suction apparatus at the lower portion of the high-temperature preheater 10*a* as well as at the lower portion of the low-temperature preheater 10*b*.

At the time of stopping the printing operation (that is, at the time of non-fixing operation), as a general operation, the pressure roller 11*b* is separated from the heat roller 11*a* thereby to release the urged state between these rollers, and further the preheater 10 and the suction apparatuses 14, 17 move away from the print sheet transfer path simultaneously or almost simultaneously. At this time, the print sheet 6 placed on the high-temperature preheater 10*a* is pushed up by the projection member 15*a* of the recording material lifting apparatus 15 provided at the high-temperature preheater 10*a*. In this case, the print sheet 6 placed on the low-temperature preheater 10*b*, whose temperature is set to such a value that the toner image on the print sheet is not adhered to the preheater 10, is kept to be adhered to the low-temperature preheater 10*b* by the suction apparatuses 14 and 17.

In this manner, in the stopping state of the printing operation, the print sheet 6 is kept to be adhered to the low-temperature preheater 10*b*. Accordingly, at the time of restarting the printing operation, it is possible to restore the print sheet 6, which was once separated from the preheater at the time of stopping the printing operation, accurately to the original position at the time of stopping the printing operation.

Although the setting temperature of the low-temperature preheater 10*b* depends on the characteristics of the toner used in the electrophotographic apparatus, it is possible to increase the setting temperature almost to 80° C. in the present embodiment. Further, the setting temperature of the high-temperature preheater 10*a* can be increased almost to 110° C. The setting temperature of the high-temperature preheater 10*a* corresponds to the setting temperature of an electrophotographic apparatus used in the case of performing the one-side printing. Accordingly, according to the present invention, the fixing intensity of the electrophotographic apparatus of the rear stage can be made substantially same as that of electrophotographic apparatus of the former stage. When the setting temperatures of the preheaters are set in the aforesaid manner, it becomes possible unlike the prior art to prevent the toner from being adhered to the surfaces of the a preheaters without providing on the surfaces of the preheaters layers formed by material such as PTFE or PFA compound to which toner is hardly adhered.

Although, in the aforesaid embodiment, the preheater 10 is formed by the high-temperature preheater 10*a* and the low-temperature preheater 10*b*, the present invention is not limited thereto. That is, the preheater 10 may one arranged to have a single setting tempearature.

Figure 5:
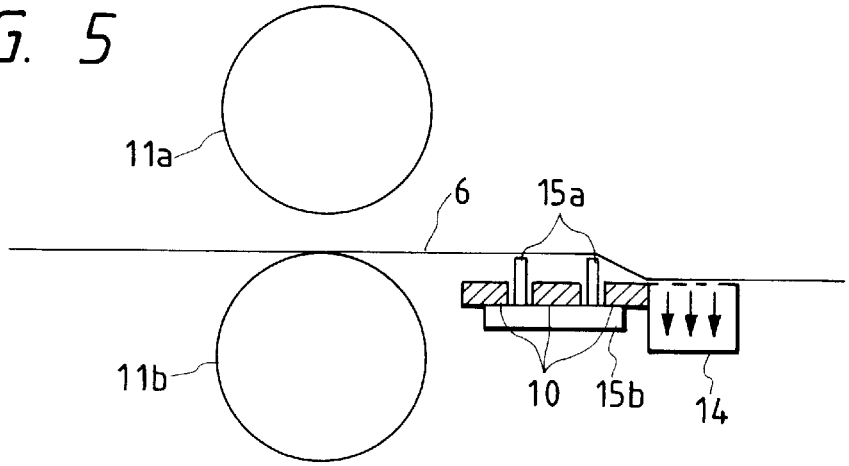
FIG. 5 is a side view showing another embodiment of the present invention.

FIG. 5 shows a stopping state of the printing operation of another embodiment using a preheater 10 in which only one setting temperature can be set. In this embodiment of such an arrangement, the deviation of the print sheet 6 due to the lift-up from the preheater 10 is prevented only by a suction apparatus 14 provided just before the preheater 10. In this case, the preheater 10 is a high-temperature preheater.

As described above, according to the present invention, the fixing intensity of the electrophotographic apparatus of the rear stage can be made substantially same as that of the electrophotographic apparatus of the former stage.

Further, according to the present invention, at the time of restarting the printing operation, it is possible to restore the print material, which was once separated from the preheater at the time of stopping the printing operation, accurately to the original position at the time of stopping the printing operation, so that it is possible to provide a printed material without any unevenness of fixed image.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fixing apparatus for an electrophotographic apparatus, comprising:

a suction unit for attracting a rear surface of a longitudinally continuous recording material on a major surface of which a toner image is held;

a preheater for preheating said recording material while adhering said recording material to said preheater by attracting force of said suction unit;

a pair of fixing rollers comprised of a heat roller and a pressure roller urged to each other, for holding and carrying said recording material therebetween while heating and pressurizing said recording material at a pressing portion therebetween to fix said toner image on said major surface of said recording material; and a recording material lifting unit having a projection member movable relative to a surface of said preheater.

2. A fixing apparatus for an electrophotographic apparatus according to claim 1, further comprising a base portion fixed to a predetermined position of said fixing apparatus;

wherein said projection member of said recording material lifting unit is provided on an upper surface of said base portion; and wherein said projection member protrudes from said surface of said preheater through an opening portion provided at said preheater by moving said preheater downward relative to said recording material lifting apparatus.

3. A fixing apparatus for an electrophotographic apparatus, comprising:

a suction unit for attracting a rear surface of a longitudinal continuous recording material on a major surface of which a toner image is held;

a preheater for preheating said recording material while adhering said recording material to said preheater by attracting force of said suction unit; and a pair of fixing rollers comprised of a heat roller and a pressure roller urged to each other, for holding and carrying said recording material therebetween while heating and pressurizing said recording material at a pressing portion therebetween to fix said toner image on said major surface of said recording material;

wherein said preheater comprises a high-temperature preheater set to generate higher temperature and provided at an upstream side along a transfer direction of said recording material with respect to said pressing portion between said recording material; and a low-temperature preheater set to generate lower temperature than the temperature of said high-temperature preheater and provided at an upstream side along said transfer direction of said recording material with respect to said high-temperature preheater; and said fixing apparatus further comprising a recording material lifting apparatus having a projection member movable relative to a surface of said high-temperature preheater.

4. A fixing apparatus for an electrophotographic apparatus according to claim 3, wherein said projection member of said recording material lifting unit is provided on an upper surface of a base portion fixed to a predetermined position; wherein said projection member protrudes from said surface of said preheater through an opening portion provided at said preheater by moving said preheater downward relative to said recording material lifting apparatus.

5. A fixing apparatus for an electrophotographic apparatus, comprising a suction unit for attracting a rear surface of a longitudinal continuous recording material on a major surface of which a toner image is held;

a preheater for preheating said recording material while adhering said recording material to said preheater by attracting force of said suction apparatus; and a pair of fixing rollers comprised of a heat roller and a pressure roller urged to each other, for holding and carrying said recording material while heating and pressurizing said heat roller and said pressure roller at a pressing portion therebetween to fix said toner image on said major surface of said recording material;

wherein said preheater comprises a high-temperature preheater set to generate higher temperature and provided at an upstream side along a transfer direction of said recording material with respect to said pressing portion between said heat roller and said pressure roller; and a low-temperature preheater set to generate lower temperature than the temperature of said high-temperature preheater and provided at an upstream side along said transfer direction of said recording material with respect to said high-temperature preheater;

wherein said suction apparatus is provided in an area of said low-temperature preheater and attracts said recording material to a surface of said low-temperature preheater; and wherein said fixing apparatus further comprising a recording material lifting unit having a projection member movable relative to a surface of said high-temperature preheater.

6. A fixing method for an electrophotographic apparatus which comprises a suction section for attracting a rear surface of a longitudinal continuous recording material on a major surface of which a toner image is held; a preheater for preheating said recording material while adhering said recording material to said preheater by attracting force of said suction apparatus; a pair of fixing rollers comprised of a heat roller and a pressure roller urged to each other, for holding and carrying said recording material while heating and pressuriziing said heat roller and said pressure roller at a pressing portion therebetween to fix said toner image on said major surface of said recording material; and a recording material lifting unit having a projection member movable relative to a surface of said preheater, said fixing method comprising the steps of:

when a fixing operation is not performed, releasing an urging state between said heat roller and said pressure roller;

adhering said recording material to said suction unit; and protruding said projection member of said recording material lifting apparatus from said preheater to float said recording material from said surface of said preheater to place in a standby state.

7. A fixing method for an electrophotographic apparatus, comprising a suction unit for attracting a rear surface of a longitudinal continuous recording material on a major surface of which a toner image is held; a preheater for preheating said recording material while adhering said recording material to said preheater by attracting force of said suction apparatus; and a pair of fixing rollers comprised of a heat roller and a pressure roller urged to each other, for holding and carrying said recording material therebetween while heating and pressurizing said recording material at a pressing portion therebetween to fix said toner image on said major surface of said recording material; wherein said preheater comprises a high-temperature preheater set to generate higher temperature and provided at an upstream side along a transfer direction of said recording material with respect to said pressing portion between said heat roller and said pressure roller; a low-temperature preheater set to generate lower temperature than that of said high-temperature preheater and provided at an upstream side along said transfer direction of said recording material with respect to said high-temperature preheater; a recording material lifting unit having a projection member movable relative to a surface of said preheater, said method comprising the steps of:

when a fixing operation is not performed, releasing an urging state between said heat roller and said pressure roller;

adhering said recording material to said suction apparatus; and protruding said projection member of said recording material lifting apparatus from said preheater to float said recording material from said surface of said preheater to place in a standby state.

* * * * *